United States Patent [19]

Haakenson

[11] 4,244,193

[45] Jan. 13, 1981

[54] AMBIENT AIR COOLING SYSTEM

[76] Inventor: Marlan H. Haakenson, 566 Sunset Pl., Bismarck, N. Dak. 58501

[21] Appl. No.: 69,343

[22] Filed: Aug. 24, 1979

[51] Int. Cl.[3] ..... F25D 17/00

[52] U.S. Cl. ..... 62/180; 62/203; 62/332; 62/409; 62/412; 165/16; 236/49

[58] Field of Search ..... 62/180, 332, 412, 203, 62/409; 165/16; 236/49

[56] References Cited

U.S. PATENT DOCUMENTS

| | | | |
|---|---|---|---|
| 2,216,873 | 10/1940 | Browne | 236/49 |
| 2,474,048 | 6/1949 | Greenlee | 236/49 |
| 2,488,518 | 11/1949 | Zucker | 236/49 |
| 3,982,583 | 9/1976 | Shavit | 62/412 |
| 4,023,947 | 5/1977 | Ferry | 62/412 |
| 4,147,038 | 4/1979 | Hoebing et al. | 62/412 |
| 4,175,401 | 11/1979 | McManus | 165/16 |

*Primary Examiner*—Ronald C. Capossela

*Attorney, Agent, or Firm*—Williamson, Bains, Moore & Hansen

[57] ABSTRACT

Apparatus for utilizing ambient air to provide supplemental cooling of a refrigerated enclosure in combination with a mechanical refrigeration system. Initial pull down of the temperature in a refrigerated enclosure to an intermediate temperature level is accomplished by a mechanical refrigeration system, or by an ambient air system in combination therewith. Cooling of the enclosure to a predetermined, low temperature level is achieved by actuating fans in response to the sensing of an outdoor temperature at or below a predetermined temperature level to draw relatively cool ambient air into the enclosure.

6 Claims, 1 Drawing Figure

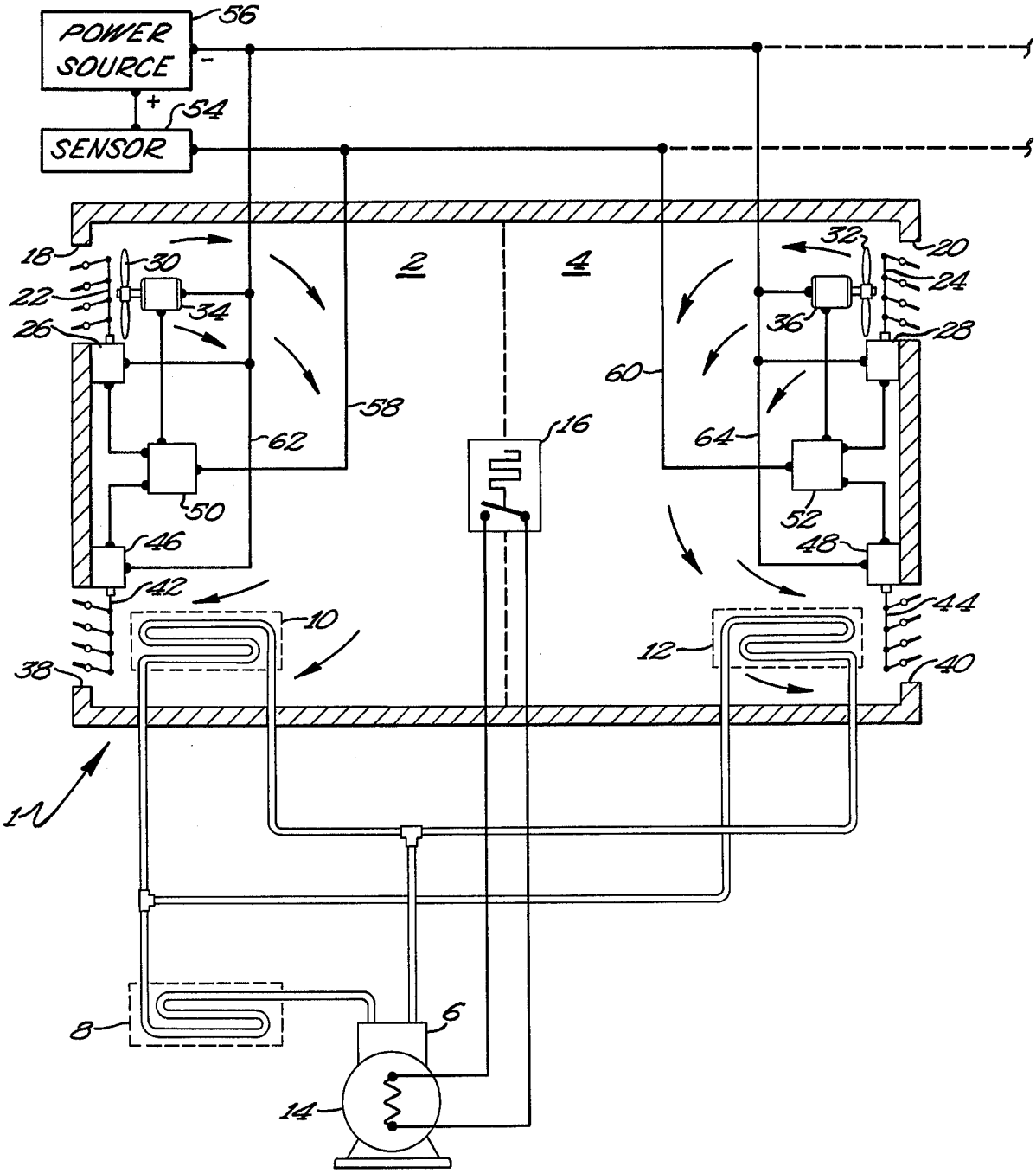
POWER SOURCE
56
-
+
54
SENSOR
18
30
22
34
26
2
4
32
20
24
36
28
60
58
62
16
64
50
52
46
48
42
44
10
12
38
40
1
8
6
14

AMBIENT AIR COOLING SYSTEM

BACKGROUND OF THE INVENTION

This invention relates to cooling systems utilizing ambient air as a cooling medium.

It is known to use ambient air for such purposes. U.S. Pat. Nos. 2,488,518 and 4,023,947 contain exemplary disclosures of systems for cooling enclosures with ambient air, either with or without conventional mechanical refrigeration apparatus. Such systems become increasingly attractive when potential energy savings are taken into account.

Prior art ambient air cooling systems such as those disclosed in the aforesaid patents offer possibilities for saving energy. However, in most instances, they are lacking as to economy of operation. One shortcoming resides in the control of such systems in such a way that the mechanical refrigeration system cools to the same low temperature level as is achieved by the ambient air handling units. Since there is an acceptable operating temperature range for most refrigerated goods, this results in an unnecessary expenditure of energy.

BRIEF SUMMARY OF THE INVENTION

This invention has as its primary objective the provision of a cooling system which utilizes ambient air so as to achieve increased energy savings through the use of add-on units which may be simply and easily installed.

This objective is achieved by a control arrangement having separate temperature control levels within a cooled enclosure for a mechanical refrigeration system and for ambient air handling units. A first thermostat responsive to the temperature within the area to be cooled is operative to actuate a mechanical refrigeration system at a predetermined, upper temperature level and to shut off the mechanical refrigeration system at a predetermined, intermediate temperature level below the upper temperature level. A second thermostat responsive to the temperature within the area to be cooled actuates an air handling unit at or above the aforesaid intermediate temperature level and deenergizes the air handling unit at a predetermined, low temperature level below the intermediate temperature level. Thus, the mechanical refrigeration system is used only to pull the temperature down in a refrigerated enclosure to an intermediate temperature level within an acceptable operating range for the goods being cooled. Final cooling to a lower temperature level and holding of the temperature in the enclosure at that low level is accomplished by the use of ambient air. The ambient air system may also be used to assist in initial pull down if outdoor temperatures permit.

In the preferred embodiment of the invention, a single temperature sensor responsive to ambient air temperature is utilized in a control circuit to actuate one or more air handling units installed in refrigerated zones or compartments. Each air handling unit is preferably comprised of a fan positioned to draw ambient air through air flow passage means into a refrigerated space, motor operated damper means to control the intake of ambient air, motor operated damper means to control the exhaust of air from the refrigerated space, and an indoor thermostat which is set to actuate the fan and damper motors to circulate ambient air through the refrigerated space when the temperature therein reaches the aforesaid, intermediate temperature level. The indoor thermostat of each air handling unit is connected in a control circuit to the outdoor temperature sensor and to its respective fan motor and damper motors. The outdoor temperature sensor is set to energize the indoor thermostats at a predetermined ambient temperature less than the aforesaid intermediate temperature level. When this condition is met, the indoor thermostats are operative to actuate their respective fans and damper motors in order to draw relatively cool, ambient air into the refrigerated spaces or zones serviced by each air handling unit, if the intermediate temperature level is exceeded within the refrigerated spaces.

These and other objects and advantages of my invention will become readily apparent as the following description is read in conjunction with the accompanying drawing.

BRIEF DESCRIPTION OF THE DRAWING

The FIGURE is a schematic illustration of the ambient air cooling system of this invention in combination with a mechanical refrigeration system, together with the related control circuitry.

DESCRIPTION OF THE PREFERRED EMBODIMENT

Referring now to the FIGURE, there is shown an ambient air cooling system in combination with a mechanical refrigeration system in accordance with my invention. Reference numeral 1 generally indicates a walled enclosure defining an area to be cooled. This enclosure may obviously take different forms. It could be a single building, or a refrigerated space within a building. For example, the enclosure may comprise a cooler for beer, of either the walk-in or reach-in type. As is often the case, the cooler may have zones or chambers subject to varying cooling loads due to such factors as proximity of access doors and frequency of adding warm product to be cooled. Two such cooling zones are indicated by reference numerals 2 and 4.

The entire area to be cooled within enclosure 1, comprising both zones 2 and 4 is cooled by a combination of a mechanical refrigeration system, and ambient air handling units as hereinafter described. The mechanical refrigeration system is comprised of a compressor 6 having a condenser 8 connected in refrigerant flow relationship with evaporators 10 and 12 disposed in the cooling zones 2 and 4 as shown. The mechanical refrigeration system is conventional. Separate evaporators 10 and 12 are shown for providing cooling within the zones 2 and 4. Alternatively, a single, large evaporator coil could be provided within the enclosure 1 for cooling the entire area therein. Compressor 6 is driven by an electric motor 14. A first thermostat 16 located within the area to be cooled, and sensing a composite temperature within zones 2 and 4, controls the operation of compressor drive motor 14 through the control circuit shown.

The refrigerating effect provided by the mechanical refrigeration system is supplemented by ambient air. To that end, refrigerated spaces or zones 2 and 4 are each provided with an air handling unit for circulating ambient air therethrough. Air flow passage means in the form of apertures 18 and 20 are provided as shown in the walls of enclosure 1 to connect the interior of the cooling zones 2 and 4 with the outdoors. The control of ambient air flow through these apertures is positively controlled by louvered intake dampers 22 and 24. The use of such dampers ensures that ambient air will not enter the cooling zones when not desired. Each of the intake dampers 22 and 24 is operated by its respective damper motor 26, 28. Fans 30 and 32, driven by motors 34 and 36 are positioned to draw ambient air into cooling zones 2 and 4 through wall apertures 18 and 20. In most applications it will be desirable to circulate ambient air over the load being cooled, and to exhaust air from the cooling zones 2 and 4. For that purpose, exhaust apertures 38 and 40 and provided as shown in the walls of each of the cooling zones. Air flow through each of these apertures is controlled by motor operated, exhaust dampers 42 and 44 of the louvered type. Operation of these dampers is accomplished by damper motors 46 and 48. Each of the air handling units further comprises an indoor thermostat, these thermostats being designated by reference numerals 50 and 52. A single, outdoor temperature sensor 54 connected to a power source 56 is employed in conjunction with indoor thermostats 50 and 52 to accomplish the controlled cycling of the ambient air handling units in response to both ambient temperature and the temperature within cooling zones 2 and 4.

The control circuit for each air handling unit is identical. Indoor thermostats 50 and 52 are connected to the output side of outdoor temperature sensor 54. With respect to cooling zone 2, indoor thermostat 50 is in turn connected to damper motors 26 and 46, and to fan motor 34. The circuit is completed back to the power source from these damper motors and the fan motor as illustrated. Similarly, in zone 4, indoor thermostat 52 is connected to damper motors 28 and 48, as well as to fan motor 36. The power supply lines leading to indoor thermostats 50 and 52 from the output side of temperature sensor 54 are indicated by reference numerals 58 and 60, and the control circuits are completed back to power source 56 through lines 62 and 64.

It will thus be seen that thermostats 50 and 52 are not energized to permit them to actuate their respective air handling units through supply lines 58 and 60 except when contacts are closed through outdoor temperature sensor 54. In accordance with my improved control arrangement, temperature sensor 54 will be set to energize indoor thermostats 50 and 52 at a predetermined ambient temperature less than an intermediate temperature level to which the refrigerated enclosure 1 may be cooled by the mechanical refrigeration system. Using the illustration of a beer cooler having a satisfactory operating temperature range of between 33 degrees and 39 degrees F., thermostat 16 will be set to actuate the mechanical refrigeration system at a temperature of 39 degrees F. The cutout temperature setting for thermostat 16 is 36 degrees F. At this intermediate temperature level it will deenergize compressor drive motor 14 so as to shut off the mechanical refrigeration system. Indoor thermostats 50 and 52 would be set to cut in at the intermediate temperature level of 36 degrees F. and to cut out at a predetermined, low temperature level of 33 degrees F. For such a beer cooling application, outdoor temperature sensor 54 would be set so that it will not cut in until the ambient temperature is below the intermediate temperature level of 36 degrees F. Desirably, in order to achieve a temperature differential which will permit the cooling of zones 2 and 4 to the low temperature control point of 33 degrees F., the ambient temperature cut-in point for outdoor temperature sensor 54 is preferably below 33 degrees F.

In operation, when the enclosure 1 is first loaded with product to be cooled, which would be beer in the application being described, the temperature within enclosure 1 would be above 39 degrees F., and thermostat 16 would thus be cut-in to actuate the mechanical refrigeration system. When the temperature within the refrigerated enclosure is cooled down to 36 degrees F., thermostat 16 will operate to shut off the mechanical refrigeration system. Any time that the ambient temperature is below the intermediate temperature level of 36 degrees F., indoor thermostats 50 and 52 will be energized. If, at the same time, the intermediate, cut in temperature level of 36 degrees F. for thermostats 50 and 52 is reached or exceeded within zones 2 and 4, intake and exhaust dampers 22, 24 and 42, 44 will be opened and fan motors 34 and 36 will be energized. Relatively cool, ambient air will then be circulated through refrigerated spaces 2 and 4 until the low temperature setting of 33 degrees F. for thermostats 50 and 52 is satisfied. When this happens, the air circulating fans 30 and 32 will be shut off and the dampers will be closed by thermostats 50 and 52. The ambient system can thus be used to assist in initial temperature pull down to the intermediate temperature level, as well as to accomplish cooling to the low temperature level, as permitted by the ambient air temperature. Any time that the temperature within refrigerated spaces 2 and 4 rises to the intermediate temperature level of 36 degrees F., and the outdoor temperature as sensed by sensor 54 is low enough to provide cooling below that level, thermostats 50 and 52 will again actuate their respective air handling units to circulate ambient air through the cooling zones 2 and 4. During the warmer seasons of the year when the ambient temperature rises above the cut-in setting of sensor 54, thermostats 50 and 52 will not be operative to actuate the air handling units. If the temperature within the refrigerated spaces or zones 2 and 4 thus continues to rise to the aforesaid upper temperature level (39 degrees F. in the case of a beer cooler) thermostat 16 will again be cut in to actuate the mechanical refrigeration system. During such warmer periods of the year, the refrigerated spaces would be maintained at the intermediate, cutout temperature of thermostat 16 (36 degrees F. in the case of a beer cooler) by the mechanical refrigeration system.

It will thus be seen that the mechanical refrigeration system is used only to assist with initial temperature pull-down within the refrigerated enclosure, and to intermittently cool the refrigerated enclosure to an intermediate temperature level within a satisfactory operating temperature range for the goods being cooled. Final cooling of the refrigerated enclosure to a predetermined, low temperature level and the holding of the temperature in the enclosure at that level is accomplished by the use of ambient air, when the ambient air temperature is at a satisfactory level for cooling purposes. Since the compression refrigeration system is used only to assist in the cooling of the enclosure to an intermediate level of an acceptable temperature range, less energy is expended.

Ambient air temperature sensor 54 may obviously be used to control any number of air handling units having their respective indoor thermostats set to be actuated at the same intermediate temperature level. For example, in a large walk-in cooler 50 feet long, four ambient air handling units could be utilized. Further economy of operation is realized by using such a plurality of air handling units, each in a separate refrigerated space or zone of an enclosure. Each air handling unit can thus be cycled independently to cool its respective zone in response to the cooling load in each zone.

As noted above, each air handling unit is comprised of motor operated intake and exhaust louvers, an air circulating fan, and an indoor control thermostat. Such add-on units may be readily installed in conjunction with existing mechanical refrigeration systems to provide supplementary cooling in the manner described herein. The ambient air cooling system as disclosed herein may be utilized in a wide range of cooling and freezing applications. Such applications would include, in addition to walk-in coolers, freezers, computer rooms, and even indoor hockey rinks. With respect to the latter application, ducts could be installed under the floor of ice rinks for conducting cold, ambient air. The settings of the outdoor temperature sensor and of the indoor temperature thermostats would of course vary depending upon the application. For freezers containing frozen foods for example, thermostat 16 could be set to cut in at zero degree F. and to cut out at −4 degrees F. The indoor thermostats 50 and 52 for the air handling units would in turn be set to cut in at −4 degrees F. and to cut out at −7 degrees F.

It is anticipated that various changes can be made in the construction and operation of the cooling system disclosed herein without departing from the spirit and scope of my invention as defined by the following claims.

What is claimed is:

1. Cooling apparatus for an enclosure comprising:

a refrigeration system comprising a compressor, condenser and evaporator interconnected in refrigerant flow relationship, said evaporator being located within the area of said enclosure to be cooled;

a first thermostat responsive to the temperature within said area to be cooled and operative to actuate said refrigeration system at a predetermined, upper temperature level and to deactivate said refrigeration system at a predetermined, intermediate temperature level below said upper temperature level;

air flow passage means connecting the interior of said enclosure with the outdoors;

fan means positioned to draw ambient air into said enclosure and said area to be cooled from the outdoors through said air flow passage means;

a second thermostat responsive to the temperature within said area to be cooled and operative to actuate said fan means at said intermediate temperature level and to de-energize said fan means at a predetermined, low temperature level below said intermediate temperature level; and an outdoor temperature sensor responsive to ambient air temperature and operative to energize said second thermostat and render it operative to actuate said fan means at a predetermined ambient temperature less than said intermediate temperature level.

2. Cooling apparatus as defined in claim 1 wherein:

motorized, damper means are positioned in said air flow passage means to control the flow of ambient air therethrough, said motorized damper means being connected in a control circuit with said second thermostat for actuation to an open position at said intermediate temperature level and for movement to a closed position at said low temperature level in response to the sensing of said intermediate and low temperature levels by said second thermostat.

3. Cooling apparatus as defined in claim 2 wherein:

said enclosure further includes at least one exhaust aperture communicating the interior thereof with the outdoors at a location spaced from said air flow passage means; and motorized, exhaust damper means positioned adjacent said exhaust aperture, said exhaust damper means being connected in said control circuit with said second thermostat for actuation to an open position at said intermediate temperature level and for movement to a closed position at said low temperature level in response to the sensing of said intermediate and low temperature levels by said second thermostat.

4. Cooling apparatus as defined in claim 1 wherein:

said enclosure has a plurality of zones to be cooled;

separate, air flow passage means connecting the interior of said enclosure within each of said zones to be cooled from the outdoors;

separate fan means positioned to draw ambient air into each of said zones to be cooled from the outdoors through said separate, air flow passage means; and a separate thermostat in each of said zones to be cooled responsive to the temperature therein and connected in a control circuit with said outdoor temperature sensor and its respective fan means, each of said separate thermostats being operative to actuate its respective fan means at said intermediate temperature level and to de-energize said fan means at said low temperature level, whereby the temperature in each of said zones to be cooled may be independently controlled between said intermediate and low temperature levels by said separate thermostats.

5. Cooling apparatus for an enclosure comprising:

a first zone to be cooled within said enclosure;

air flow passage means connecting the interior of said first zone with the outdoors;

first fan means positioned to draw ambient air into said first zone of said enclosure through said air flow passage means;

a first thermostat responsive to the temperature within said first zone and operative to actuate said first fan means to draw ambient air into said first zone at a predetermined temperature level and to de-energize said first fan means at a predetermined, lower temperature level;

a second zone to be cooled within said enclosure;

second air flow passage means connecting the interior of said second zone with the outdoors;

second fan means positioned to draw ambient air into said second zone of said enclosure through said second air flow passage means;

a second thermostat responsive to the temperature within said second zone and operative to draw ambient air into said second zone at said predetermined temperature level and to de-energize said second fan means at said predetermined, lower temperature level; and an outdoor temperature sensor responsive to ambient air temperature and connected in a control circuit with both said first and second thermostats, said outdoor temperature sensor being operative to energize both of said thermostats to render them operative to actuate either or both of said fan means to draw ambient air into either or both of said zones to be cooled at a predetermined ambient temperature less than said predetermined temperature at which said thermostats are set to actuate said first and second fan means.

6. Cooling apparatus for an enclosure as defined in claim 5 wherein:

said cooling apparatus further comprises a refrigeration system comprising a compressor, condenser and evaporator means interconnected in refrigerant flow relationship, said evaporator means being located within said first and second zones to be cooled; and a refrigeration system control thermostat responsive to the temperature within said zones to be cooled and operative to actuate said refrigeration system at a predetermined, upper temperature level and to deactivate said refrigeration system at a predetermined, intermediate temperature level the same as said predetermined temperature level at which said first and second thermostats are set to actuate said first and second fan means.

* * * * *